United States Patent [19]

Van Wyk

[11] 4,256,489

[45] Mar. 17, 1981

[54] LOW WEAR HIGH CURRENT DENSITY SLIDING ELECTRICAL CONTACT MATERIAL

[75] Inventor: Jan W. Van Wyk, Kirkland, Wash.

[73] Assignee: The Boeing Company, Seattle, Wash.

[21] Appl. No.: 2,373

[22] Filed: Jan. 10, 1979

[51] Int. Cl.[3] ..... C10M 5/00; C10M 7/00

[52] U.S. Cl. ..... 75/173 R; 75/173 A; 75/231; 75/232; 75/233; 75/235; 75/246; 252/11; 252/12

[58] Field of Search ..... 252/11, 12; 75/173 R, 75/173 A, 231, 232, 233, 235, 246

[56] References Cited

U.S. PATENT DOCUMENTS

| | | | |
|---|---|---|---|
| 3,755,164 | 8/1973 | Van Wyk | 252/12 |
| 3,956,146 | 5/1976 | Tsuya et al. | 252/12 |

FOREIGN PATENT DOCUMENTS

| | | | |
|---|---|---|---|
| 49-1338 | 1/1974 | Japan | 252/12 |
| 2201380 | 7/1973 | Fed. Rep. of Germany | 252/12 |

*Primary Examiner*—L. Dewayne Rutledge
*Assistant Examiner*—Upendra Roy
*Attorney, Agent, or Firm*—David L. Garrison; Robert L. Gullette

[57] ABSTRACT

A solid, self lubricating bearing material especially useful as a sliding electrical contact in vacuum environments comprising a high temperature lubricant chosen from $AlPO_4$, $BaF_2$, $CaF_2$ and mixtures thereof, a lower temperature solid lubricant chosen from the chalcogenides which exhibit lubricity, & a silver matrix, the ratio of high temperature lubricant to silver being about 1:4 to 1:10, the ratio of lower temperature lubricant to silver being about 1:2 to 1:8. Filler materials up to 20% by weight chosen from aluminum oxide, silicon nitride, molybdenum silicide, metals from Group 8 of the Periodic Table, and mixtures thereof may be added to alter the hardness of the material.

9 Claims, No Drawings

LOW WEAR HIGH CURRENT DENSITY SLIDING ELECTRICAL CONTACT MATERIAL

TECHNICAL FIELD

This invention relates to solid, self lubricating materials that, in addition to having low friction and low wear characteristics, exhibit the ability to carry high current densities without excessive heating and exhibit a minimum of voltage drop. These materials may be utilized in reduced atmospheric to high vacuum conditions such as may be encountered in space vehicle applications.

BACKGROUND ART

The primary problems of the sliding electrical contact in an ultra high vacuum environment include cold welding, rapid wear and signal distortion. It is known to prevent the cold welding of sliding electrical contact by the addition of a surface lubricant; however, in instances which life of the operating device must be measured in years, the application of surface lubricants becomes cumbersome, if at all possible. Several self lubricating materials are known in the prior art that possess good lubricating properties and low shear strength. Typical examples are molybdenum disulfide, molybdenum diselenide, tunsten disulfide and graphite. Generally these materials have suitable application methods where low friction characteristics are desired under low stress conditions. However, a long, trouble free life and relatively high loading are frequently required. The high stress conditions induced therby cause frequent failure of the prior materials due to low strength characteristics and inadequate lubrication. With the possible exception of graphite, these prior art self lubricating materials have low tolerance to high temperatures and cannot be used in systems to more than a few hundred degrees Farenheit. Graphite along, amongst these prior art materials, exhibits substantially electrical conductivity but it cannot be used in systems operating in vacuum, since under vacuum conditions the graphite particles become abrasive. It is also known to add high temperature additives, having lubricative properties to a metal matrix; the high temperature lubricants being, for example, aluminum phosphate, barium fluoride and/or calcium fluoride, to form bearing structures. In my prior U.S. Pat. No. 3,755,164, issued Aug. 28, 1973, I disclose a self lubricating bearing of the above description having oxidation resistant, high temperature lubricants including aluminum phosphate, barium fluoride and calcium fluoride dispersed throughout a matrix of silver further including an additive such as aluminum oxide, silicon nitride, or molybdenum silicide. The resulting composition, when pressed and sintered, exhibits good properties for a bearing structure operable at elevated temperatures. However, it has been found that such compositions, while exhibiting relatively good lubricative properties for atmospheric usage at elevated temperatures cannot be utilized in extended life operations under high vacuum conditions due to their rate of wear.

DISCLOSURE OF THE INVENTION

A self lubricating material especially useful in high vacuum sliding electrical contact devices which must operate for many years without maintenance is prepared using well known powder metalurgy techniques. The powder or granular ingredients are pre-mixed and placed into a suitable mold, preferably graphite, and then subjected to heat and pressure to sinter and consolidate the self lubricating material. The material comprises a metal matrix containing both a high temperature and low temperature solid lubricant dispersed throughout. Filler materials and certain metals may be added to enhance the strength and wear characteristics, the filler material being selected from aluminum oxide, silicon nitride, molybdenum silidide, metals from Group 8 of the Periodic Table and mixtures thereof, ranging in weight up to about 30 weight percent of the total composition. The ratio by weight of high temperature lubricant to silver ranges from about 1:4 to 1:10. The high temperature lubricant is chosen from aluminum phosphate, barium fluoride and calcium fluoride. The ratio by weight of the lower temperature solid lubricant to silver ranges from about 1:2 to 1:8. The lower temperature solid lubricant is selected from the chalcogenides which have a layer lattice structure and are lubricative such as the sulfides and tellurides compounded with the Group V-B and VI-B refractory metals of the Periodic Table such as molybdenum, niobium, tantalum and tungsten or with the rare earth material metals such as holmium, samarium and yttrium. The superior lubricant characteristics of the material disclosed herein for use in high vacuum application apparently results from the synergistic combination of the high temperature solid lubricants (aluminum phosphate, barium fluoride and calcium fluoride) with the relatively low temperature solid lubricants known as chalcogenides which exhibit solid lubricant properties. The resulting material has the hardness thereof further enhanced by the addition of iron, and other additives to a level heretofore unobtainable by solid self lubricating materials. The relatively hard yet machinable contact material is formed by combining together the high temperature solid lubricant, the lower temperature solid lubricant, and the metallic matrix material, all present in a minus 325 mesh particle size or smaller, pressing the mixture into a suitable form and sintering the mass together. The resulting roughly formed materials are then machined into the desired shape for usage. The desirable hardness characteristics are provided primarily by the incorporation of additives into the silver matrix with the high temperature and low temperature lubricant material present to provide lubricity. The combination of the high temperature and low temperature self lubricating components exhibit an apparent synergistic lubricating effect which minimizes wear when the materials are used in sliding electrical contact applications. When compared with compositions containing only the low temperature solid lubricant or only the high temperature solid lubricant, higher wear rates are observed than is encountered with the electrical contact material taught herein. The compositions of matter of this invention can either be fabricated in their form such as by using dies having close tolerances to the finished product or they may be fabricated in bulk sizes and later machined to the final configuration. In either case, the compositions possess special properties and lubricative constituents that enable them to be used under relatively high stress levels in vacuum or outer space conditions as sliding electrical contacts for extended periods of time in situations in which maintenance by direct access of workers is difficult or impossible. Even though molybdenum disulfide generally exhibits high electrical resistivity, its incorporation within the metallic matrix taught herein does not destroy the electrical conductivity contributed by the metal.

It is therefore an object of this invention to provide a material which exhibits good electrical conductivity while providing sufficient lubricity for use as a sliding contact material in electrical conduction devices.

It is a second object of this invention to provide an electrical contact device for sliding contact with a adjacent metallic member which can be operated without topical application of lubricants in a vacuum or outer space environment.

It is another object of this invention to provide an electrical contact material having high lubricity provided by the synergistic interaction of a high temperature solid lubricant and a low temperature solid lubricant incorporated into the matrix of said material.

It is another object of this invention to provide a wear resistant sliding electrical contact material having a high degree of hardness and being capable of carrying high current densities.

It is still another object of this invention to provide a self lubricating material containing a relatively low temperature lubricative component and a relatively high temperature lubricative component which together provide lubricative properties for long life of sliding contact devices used in vacuum applications.

These and other objects of this invention will become apparent from an evaluation of the following disclosure of the preferred embodiment and the appended claims.

BEST MODE OF CARRYING OUT THE INVENTION

The low wear high current density sliding electrical contact material taught by this invention has as major constituents several components which can be grouped within the following categories:

1. A high temperature solid lubricant such as the metallic phosphates and fluorides which exhibit lubricative properties. Exemplifications of this category of materials include aluminum phosphate ($AlPO_4$), barium fluoride ($BaF_2$), and calcium fluoride ($CaF_2$).

2. Relatively low temperature solid lubricants classed as the chalcogenides which exhibit solid lubricant properties. Exemplifications of such materials include the sulfides, selenides, and tellurides of the Group V-B and VI-B refractory metals of the Periodic Table, niobium, molybdenum, tantalum, tungsten, or with the rare earth metals such as holmium, samarium and yttrium.

3. A matrix of silver, or other highly conductive metal compatible with the solid lubricants listed above.

4. A metal or other additive to add hardness and strength to the matrix chosen from the Group 8 metals of the Periodic Table, aluminum oxide, silicon nitride, molybdenum silicide and mixtures thereof.

The actual composition ranges useful in this invention are set forth below in Table I. This table sets forth the useful range and the preferred embodiment of the components of the material of this invention.

TABLE I

| CONSTITUENT | PREFERRED EMBODIMENT weight percent | OPERABLE RANGES weight percent |
|---|---|---|
| Al $PO_4$ | .14 | |
| Ba $F_2$ | 1.17 | .5–8 |
| Ca $F_2$ | 1.1 | |
| Ag | 72.5 | 60–90 |
| Layer | | |
| Lattice Structure | 13 | 2–24 |

TABLE I-continued

| CONSTITUENT | PREFERRED EMBODIMENT weight percent | OPERABLE RANGES weight percent |
|---|---|---|
| Lubricative Chalcogenides | | |
| Filler Materials: | | |
| Aluminum Oxide | | |
| Silicon Nitride | 12 | 0–20 |
| Molybdenum Silicide | | |
| Iron | | |

To evaluate the wear characteristics of the known prior art materials and the materials taught herein, a test mechanism was conceived which is operated under vacuum in which the sliding contact materials being tested are operated against a silver slip ring assembly for an extended period of time. This test device simulated a means of transferring power from a solar power satellite across a rotary joint to a microwave transmitter. The slip ring design used for the testing consisted of a silver slip ring having a diameter of 15", a width of ½" and a thickness of 1/16". The rings were made of coin silver. Coin silver is harder and more wear resistant than fine silver and has an electrical conductivity of about 83% that of fine silver. Each ring was contacted by a parallel set of identical brushes mounted on two different cantilever spring arms. Positive and negative brush tests were produced with a series connected current flow through the rings. Each brush rode in a separate track to minimize the effects of wear debris from the other brush. The brushes were in the form of buttons that were either cemented or soldered to the spring arms of the brush holder. The brushes tested had the following compositions:

TABLE II

| BRUSH NUMBER | MATERIAL COMPOSITION |
|---|---|
| A | 0.8% $AlPO_4$ + 6.56% $BaF_2$ + 6.19% $CaF_2$ + 81.39% Ag + 5.06% $Al_2O_3$ |
| B | 0.14% $AlPO_4$ + 1.17% $BaF_2$ + 1.10% $CaF_2$ + 12.08% Fe + 72.51% Ag + 13.0% $MoS_2$ |
| C | 80% $MoS_2$ + 15% Mo + 5% Ta |
| D | 52.94% $WS_2$ + 11.76% Co + 35.3 Ag |

The slip ring testing devices were run at the following operating parameters, to simulate the long term operating conditions expected in satellite operations:

TABLE III

| Parameter | Value |
|---|---|
| Current Density | 180–360 amperes per sq. inch |
| Temperature | 60° C. |
| Vacuum Range | 110 microns to $2 \times 10^{-7}$ Torr |
| Brush Pressure | 4.5 to 11.25 PSI |
| Average Ring Velocity | 0.28 rpm |
| Average Brush Velocity | 30.1 cm/minute |

The testing procedure was set up and operated as set forth above. The average brush wear is as set forth below in Table 4.

TABLE IV

| BRUSH NUMBER | BRUSH SHAPE | BRUSH DIMENSIONS | AVERAGE WEAR 1460 Hrs | AVERAGE WEAR 2014 hrs |
|---|---|---|---|---|
| A | Square | W = 4.227 mm L = 3.18 mm | 0.003in | 0.0035 in |
| B | cylindrical | D = 4.77 mm L = 3.18 mm | 0.0008in | 0.00125 in |
| C | cylindrical | D = 4.77 mm L = 3.18 mm | 0.001in | 0.001 in |
| D | cylindrical | D = 4.77 mm | 0.001in | 0.00175 in |

TABLE IV-continued

| L = 3.18 mm | | |
|---|---|---|
| BRUSH NUMBER | AVERAGE VOLTAGE DROP RANGE (milivolts) | OPERATING TEMP. RANGE (°C.) |
| A | 41–95 | 26.1–40 |
| B | 40–366 | 26.1–40 |
| C | 310–780 | 42.7–107.8 |
| D | 70–137 | 27.2–42.2 |

Both brush B and C exhibited wear rates satisfactory for the intended purpose however, the voltage drop levels of brush C are too high for usage in the intended application. From the above testing, it is apparent that the low wear sliding electrical contact material described herein comprising high temperature solid lubricants such as aluminum phosphate, barium fluoride and calcium fluoride combined with the low temperature solid lubricant chalcogenides which exhibit solid lubricant properties in a matrix of silver metal provides the superior operating characteristics necessary for application as a sliding contact in a low vacuum extended service transmission of relatively high current levels.

INDUSTRIAL APPLICABILITY

The materials described herein will find application in sliding electrical contact for the transfer of high current electrical transmission such as will be encountered in solar power generating satellites which in turn transmit power to the earth's surface via microwave transmission as well as other electrical contact systems in which a relatively hard self lubricating brush material is required for extended usage in low rates of travel upon conductor surfaces and in other high vacuum situations in which relatively high current must be transferred through a sliding contact mechanism.

While the inventor has set forth the invention herein in terms of specific embodiments, it is to be understood that this invention may be modified without departing from the spirit of this invention or the scope of the following claims.

I claim:

1. A solid, wear resistant, electrical contact material for use in vacuum environments having a high temperature lubricant and low temperature lubricant in a silver matrix, said material consisting essentially of:

(a) from 0.5 to 8 percent by weight of a high temperature lubricant chosen from the group consisting of $AlPO_4$,$BaF_2$, and $CaF_2$ and combination thereof;

(b) from 2 to 24 percent by weight of chalcogenides of group V-B and VI-B of the Periodic Chart which exhibit lubricative properties; and, (c) from 60 to 90 percent by weight silver as a matrix for said high temperature and low temperature lubricants.

2. The material of claim 1 wherein said high temperature lubricant is present in a ratio by weight to silver from 1:4 to 1:10.

3. The material of claim 1 or 2 wherein said low temperature lubricant present in a ratio to silver of from 1:2 to 1:8.

4. An electrical contact material according to claim 1 or 2 further containing from 0 to 20 percent iron by weight.

5. An electrical contact material according to claim 1 or 2, further containing up to 20% by weight of a filler material chosen from the group consisting of aluminum oxide, silicon nitride, molybdenum silicide and metals of Group 8 of the Periodic Table.

6. A self lubricating material formed by mixing together the powdered constituents and sintering, said material consisting essentially of a high temperature lubricant chosen from the group consisting of aluminum phosphate, barium fluoride and calcium fluoride; a lower temperature lubricant chosen from the chalcogenides having layer lattice structure and exhibiting lubricating properties; and, a matrix of silver wherein the ratio of said high temperature lubricant to silver ranges from about 1:4 to 1:10 and the ratio of said lower temperature lubricant to silver ranges from about 1:2 to 1:8.

7. The material of claim 6 further including iron present in the amount of up to 20 percent by weight.

8. The material of claim 6 further including up to 20 percent by weight of a filler material selected from the group consisting of aluminum oxide, silicon nitride, molybdenum silicide, metals from Group 8 of the Periodic Table and mixtures thereof.

9. A self lubricating solid wear resistant material capable of carrying high current densities for use as a sliding electrical contact in vacuum environments consisting essentially of:

about 0.14 percent by weight $AlPO_4$;
about 1.17 percent by weight $BaF_2$;
about 1.1 percent by weight $CaF_2$;
about 12.08 percent by weight iron;
about 13 percent by weight $MoS_2$; and
about 72.51 percent by weight silver.

* * * * *